US005114309A

United States Patent [19]

Hengelmolen

[11] Patent Number: 5,114,309

[45] Date of Patent: May 19, 1992

[54] HOT GAS BLOWER WITH LAMINATED FAN BLADES AND COOLING SYSTEM THEREFOR

[75] Inventor: Adrianus J. Hengelmolen, Nottingham, England

[73] Assignee: Copermill Limited, Nottingham, England

[21] Appl. No.: 568,011

[22] Filed: Aug. 16, 1990

[30] Foreign Application Priority Data

Nov. 28, 1990 [GB] United Kingdom ..... 8926815

[51] Int. Cl.[5] ..... F01D 25/08

[52] U.S. Cl. ..... 415/114; 415/112; 415/116; 416/223 A; 416/229 A

[58] Field of Search ..... 415/110-112, 415/114-116, 175; 416/90 R, 90 A, 92, 93 R, 96 R, 97 R, 223 R, 223 A, 229 R, 229 A, 213 R

[56] References Cited

U.S. PATENT DOCUMENTS

| | | | |
|---|---|---|---|
| 2,215,945 | 9/1940 | Vincent . | |
| 2,229,799 | 1/1941 | Dean | 416/92 |
| 2,229,799 | 1/1941 | Dean . | |
| 2,553,078 | 5/1951 | Buck | 415/115 |
| 2,601,030 | 6/1952 | Klein et al. | 415/115 |
| 2,778,601 | 1/1957 | Eckert | 416/96 R |
| 3,556,676 | 1/1971 | Gorbunov et al. | 416/96 R |

FOREIGN PATENT DOCUMENTS

| | | | |
|---|---|---|---|
| 0011649 | 2/1929 | Australia | 416/90 R |
| 0294703 | 12/1987 | Japan | 416/96 R |

*Primary Examiner*—Edward K. Look
*Assistant Examiner*—Christoher M. Verdier
*Attorney, Agent, or Firm*—Paul & Paul

[57] ABSTRACT

The fan blades of a hot gas blower are cooled by the forced passage of cooling air or gas through the blades, the cooling air or gas being vented either into the hot gases or being isolated therefrom and being recirculated after cooling.

7 Claims, 2 Drawing Sheets

HOT GAS BLOWER WITH LAMINATED FAN BLADES AND COOLING SYSTEM THEREFOR

The present invention relates to hot gas blowers and more particularly to blowers suitable for extraction of exhaust gases from furnaces.

The main problem with such blowers is that the exhaust gases from furnaces can vary in temperature from a low temperature, for example on start up of the furnace, to a very high temperature. In certain systems the blower may not be used continuously but may be switched on, for example when the furnace temperature rises above a predetermined safety limit. In these circumstances the gases blown by the blower will be extremely hot and the blower temperature will rise extremely rapidly putting great thermal strain on the blade structure of the blower.

In a known blower the blades are constructed from a metal capable of withstanding extremely high temperatures but, even with this precaution, the blade structure is found to fail after prolonged use.

It is an object of the present invention to provide a blower capable of handling extremely hot gases and which is less susceptible to failure than previous known designs.

The present invention therefore provides a hot gas blower including blade means mounted for rotation on a spindle, in which the blade means comprises a plurality of blades of predetermined size and shape to blow hot gases in a desired direction, and in which each blade includes air passage means for the passage of cooling air or gas through the blade to reduce the excessive temperature of the blade means.

Preferably each blade comprises a laminated structure, the air passage means comprising a plurality of elongate passages formed in the structure in a direction along the length of the blade.

Preferably the plurality of the blades comprising the blade means are attached to a central boss, the boss being mounted on the spindle for rotation therewith, the boss being provided with passageways connecting to the passageways in the blades.

Preferably the passageways in the boss form a plurality of entrances which are connected to a cylindrical shaped chamber surrounding the spindle, the cylindrical shaped chamber being formed with a plurality of entrances for the cooling air or gas, in which the plurality of entrances are sealed by a circumferential seal, the seal being provided with air or gas inlet means.

Preferably each blade is substantially rectangular and has a cross section which is substantially flat with a raised central portion providing additional rigidity.

Preferably each blade is constructed from two sheets of heat resistant metal, the sheets being separated by elongate spacing pieces, each sheet being welded to the spacing pieces, such that the spacing pieces form the air passages through the blade.

Embodiments of the present invention will now be described, by way of example with reference to the accompanying drawings, in which.

Figure 1:
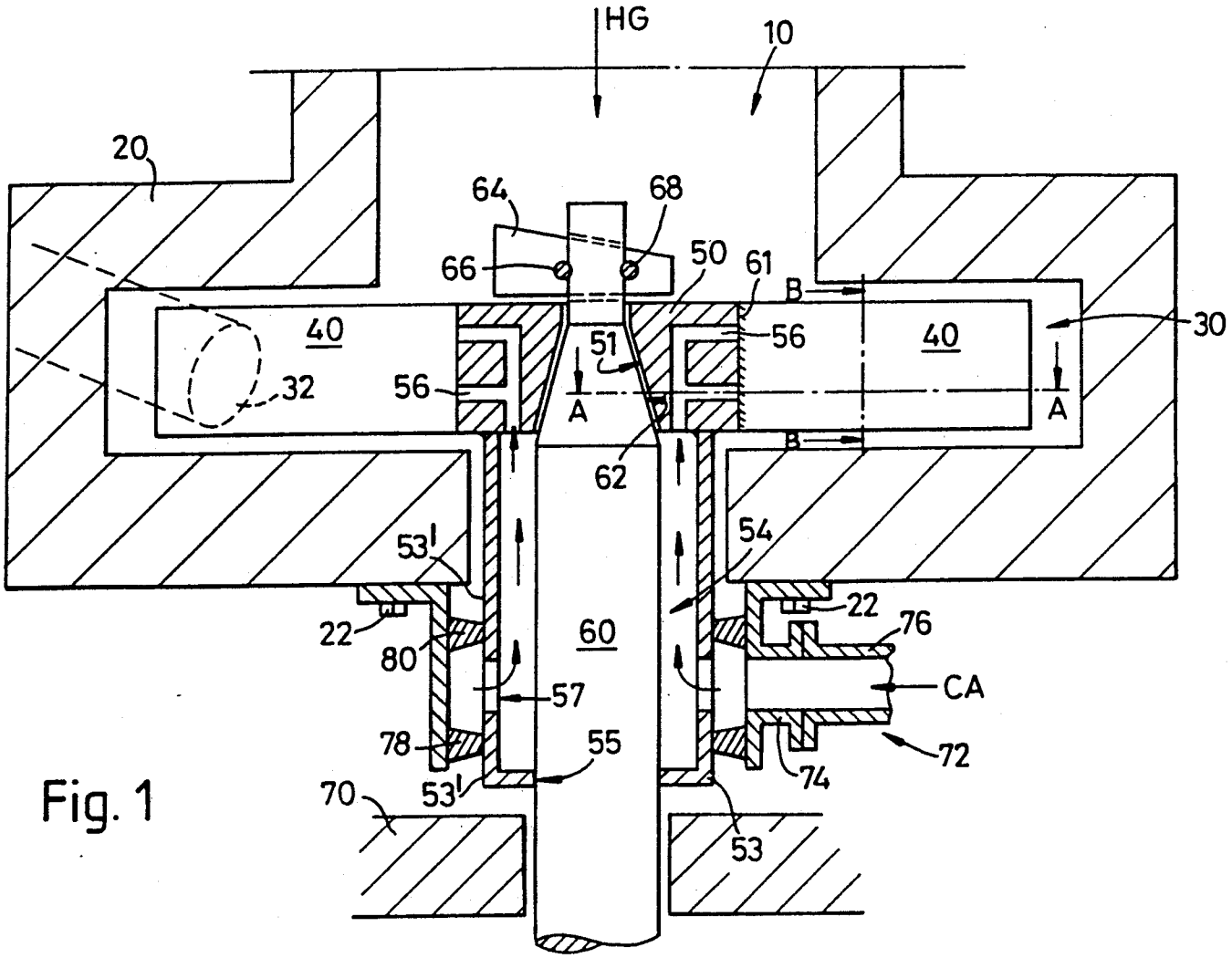
FIG. 1 shows a diagrammatic cross-sectional view of a hot gas blower according to the present invention.
Figure 2:
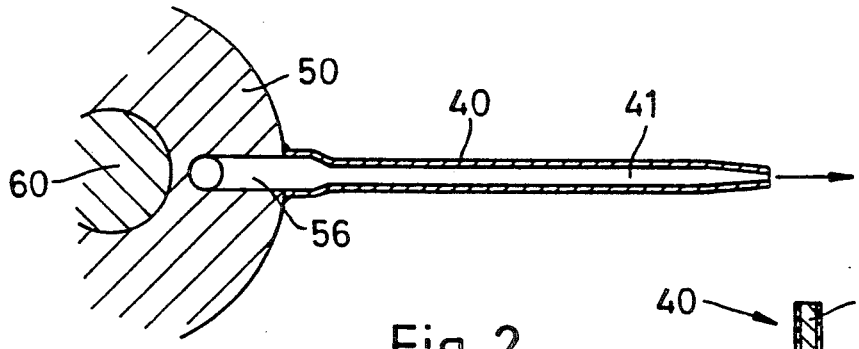
FIG. 2 shows a cross-section of a blade and central boss portion along line A—A.
Figure 3:
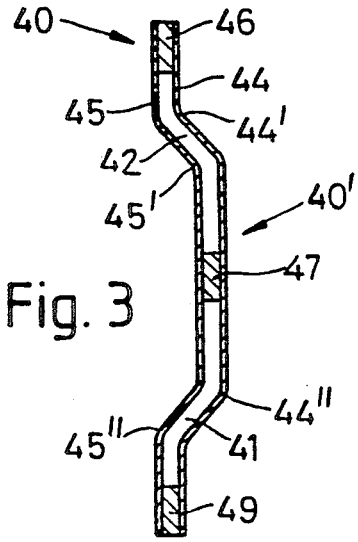
FIG. 3 shows a cross-section of a blade along line B—B.

With reference now to FIGS. 1 to 3 the hot gas blower 10 comprises a circular housing 20 forming a chamber 30. The blower is a radial blower and blows hot gas, H.G., in a direction indicated by the arrow from, for example, a furnace to a radial outlet 32 (shown dotted) to which may be connected a heat regenerator or other piece of apparatus.

The operation of radial blowers is well known and will not be further described.

The blower may be of the axial type in which case the blades 40 will require to be of different shape as is well known.

Each blade 40 is mounted or formed integrally with a central boss 50, the boss 50 being provided with a cone shaped bearing surface 51 which co-operates in known manner with a spindle 60 also provided with a cone shaped bearing surface 62. Boss 50 is held onto spindle 60 by a wedge locking member 64 suitably pinned 66, 68. Spindle 60 is supported in bearing 70 and driven by a motor (not shown) preferably of an electric type.

Attached to boss 50 is a cylindrical cover member 53 which forms a cylindrical shaped chamber 54 which "surrounds" spindle 60. The cover may be sealed at its lower end 55 by suitable sealant to form a gas tight seal.

Boss 50 is formed with a plurality of air passages 56 shaped as shown to provide passageways for cooling air or gas C.A. to be distributed to each blade as explained hereinafter.

The cooling air C.A. is supplied under pressure as indicated by arrow C.A. to an inlet structure 72. The inlet structure comprises a pipe joint member 74 connecting to an inlet pipe 76, the pipe joint member being fitted to the housing 20 by any suitable means such as bolts 22. The pipe joint member 74 is cylindrical in shape and surrounds chamber 54 and spindle 60 and is provided with two cylindrical seal members 78, 80 which bear onto the mechanical surface 53' of chamber 54 to form a seal on either side of a plurality of inlet holes 57 which allows access to chamber 54 for the cooling air C.A.

Each blade 40 is constructed as show in FIGS. 2 and 3 to have elongate air passages 41 therein which extend the whole length of the blade. Cooling air is directed by these passages down the blade and emerges at the blade tip to be mixed with the exhaust gases H.G. The blade is thereby cooled by the air C.A. and excessive heating is prevented. The blade heats up more slowly and thereby excessive stress is prevented.

In FIG. 3 three passages 41, 42, 43 are shown for the cooling air, this being a preferred design in which the blade is formed from two pieces of sheet metal 44, 45 which are separated by elongate metal dividers 46, 47, 48, 49. Preferably the dividers 46, 47, 48, 49 are spot welded to the sheets 44, 45 and then preferably the blade structure is welded to the boss 60 as indicated at 61 (FIG. 1).

The blade is preferably made from material capable of withstanding high temperatures, such materials being well known.

In FIG. 3, three passageways are shown whereas in FIG. 1 only two outlets 56 from boss 50 are shown. It is relatively easy to modify boss 50 to provide three spaced outlets.

In the cross-section shown in FIG. 3, the blade 40 is substantially flat but is provided with a central portion formed by bending the sheets 44, 45 as shown at 44', 45', and 44'', 45'' to form a raised portion 40'. This gives added strength to the blade.

Figure 4:
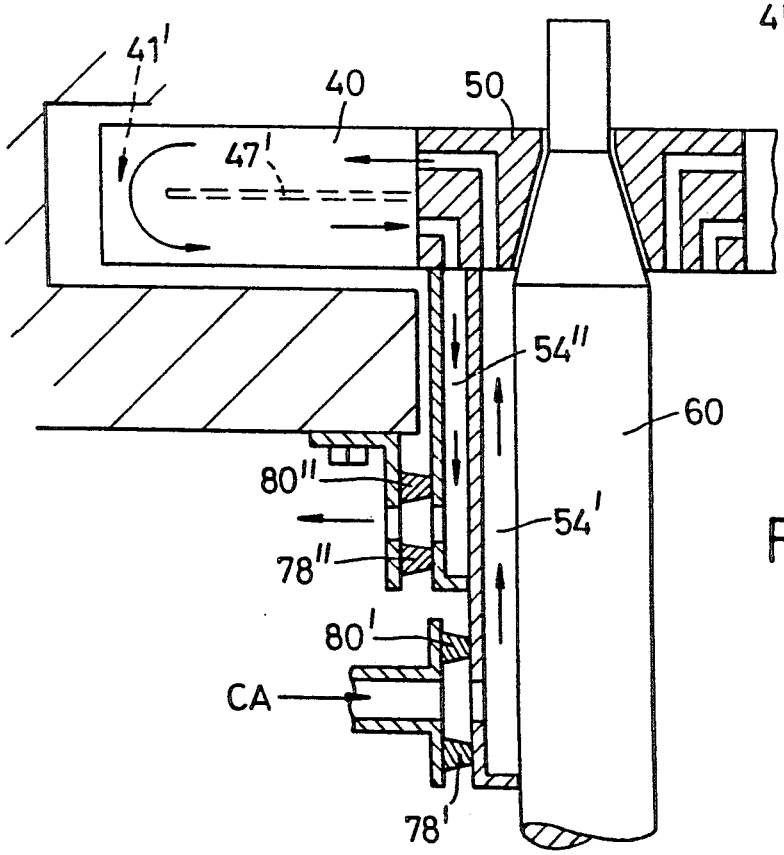
FIG. 4 shows a diagrammatic cross-sectional view of an alternative hot gas blower according to the present invention.

With reference to FIG. 4 an alternative embodiment is shown in which parts having the same or similar function are given the same reference numerals.

This embodiment is to comply with circumstances in which the cooling air C.A. is not allowed to be mixed with the hot gases H.G. — for example in case the hot gases (which could be poisonous fumes) escape via the cooling air input route.

In FIG. 4 only those parts are shown which are essential to explain the operation, other parts being as in FIGS. 1 to 3.

Cooling air C.A. is input to chamber 54 which is divided into two compartments 54' and 54''. Compartment 54' delivers cooling air C.A. to fan blades 40 (as in FIG. 1) and compartment 54'' receives the cooling air C.A. after it has passed round a now closed route within fan blade 40 — the ends of each blade being closed by for example welding. Divider 47' is shortened to allow an end passage 41' thereby causing cooling air C.A. to flow to the end of each blade and then back to chamber 54'' from which it may be recirculated by suitable pump means (not shown) or vented to the atmosphere.

Seals 78', 80' and 78'', 80'' are provided for each chamber 54', 54'' respectively.

Thus the cooling air C.A. is not allowed to be mixed with the hot gas H.G. This therefore allows the use of cooling gases other than air which may be retained by a closed circuit system preferably including radiator means for cooling the gas.

I claim:

1. A hot gas blower for blowing hot exhaust gases in a desired direction, the hot gas blower including inlet means for said hot exhaust gases and outlet means for said hot exhaust gases, housing means, blade means mounted within said housing means, a spindle, the spindle being mounted for rotation within the housing means, the blade means being mounted on said spindle for rotation therewith, in which the blade means comprises a plurality of blades of predetermined size and shape to blow said hot gases from said inlet means to said outlet means, wherein each blade includes air passage means for the passage of cooling air or gas through the blade, in which each blade comprises a laminated structure, the air passage means comprising a plurality of elongate passages formed in the structure in a direction along the length of the blade, in which each blade is substantially rectangular and has a cross section which is substantially flat with a raised central portion providing additional rigidity and, in which each blade is constructed from two sheets of heat resistant metal, the sheets being separated by elongate spacing pieces, each sheet being welded to the spacing pieces, such that the spacing pieces form the elongate air passages through the blade.

2. The hot gas blower of claim 1 in which the plurality of the blades comprising the blade means are attached to a central boss, the boss being mounted on the spindle for rotation therewith, the boss being provided the passageways connecting to the elongate passages in the blades.

3. The hot gas blower of claim 2 in which the passageways in the boss form a plurality of entrances which are connected to a first cylindrical shaped chamber surrounding the spindle, the cylindrical shaped chamber being formed with a plurality of entrances for the cooling air or gas, in which the plurality of entrances are sealed by a circumferential seal, the seal being provided with air or gas inlet means.

4. The hot gas blower of claim 1 in which each blade is provided with at least one outlet for the cooling air at the periphery of the blade.

5. The hot gas blower of claim 3 in which each blade is provided with an outlet for the cooling air, the outlet being connected to an outlet passage, the outlet passage comprising a second cylindrical shaped chamber surrounding the first cylindrical shaped chamber, the second cylindrical shaped chamber being formed with a plurality of second entrances for the exit of cooling air or gas, in which the plurality of second entrances are sealed by a second cylindrical seal.

6. The hot gas blower of claim 5 in which each blade is provided with an internal end passage within the blade for the cooling air to an outlet passage within the blade for the cooling air, the path for the cooling air thereby comprising an elongate U shaped path.

7. A hot gas blower for blowing hot exhaust gases in a desired direction, the hot gas blower including inlet means for said hot exhaust gases and outlet means for said hot exhaust gases, housing means, blade means mounted within the said housing means, a spindle, the spindle being mounted for rotation within the housing means, the blade means being mounted on said spindle for rotation therewith, in which the blade means comprises a plurality of blades of predetermined size and shape to blow said hot gases from said inlet means to said outlet means, wherein each blade includes air passage means for the passage of cooling air or gas through the blade, in which each blade comprises a laminated structure, the air passage means comprising a plurality of elongate passages formed in the structure in a direction along the length of the blade, in which the plurality of the blades comprising the blade means are attached to a central boss, the boss being mounted on the spindle for rotation therewith, the boss being provided with passageways connecting to the elongate passages, in which each blade is substantially rectangular and has a cross section which is substantially flat with a raised central portion providing additional rigidity, in which each blade is constructed from two sheets of heat resistant metal, the sheets being separated by elongate spacing pieces each sheet being welded to the spacing pieces, such that the spacing pieces form the elongate air passages through the blade, in which the passageways in the boss form a plurality of entrances which are connected to a first cylindrical shaped chamber surrounding the spindle, the cylindrical shaped chamber being formed with a plurality of first entrances for the cooling air or gas, in which the plurality of first entrances are sealed by a first circumferential seal, the seal being provided with air or gas inlet means in which each blade is provided with an outlet for the cooling air, the outlet being connected to an outlet passage, the outlet passage comprising a second cylindrical shaped chamber surrounding the first cylindrical shaped chamber the second cylindrical shaped chamber being formed with a plurality of second entrances for the exit of cooling air or gas, in which the plurality of second entrances are sealed by a second cylindrical seal, and in which each blade is provided with an internal end passage, the internal end passage connecting to an inlet passage within the blade for the cooling air to an outlet passage within the blade for the cooling air, the path for the cooling air thereby comprising an elongate U shaped path, the cooling air thereby passing through each blade to provide cooling for each blade but being completely isolated from the hot exhaust gases.

* * * * *

UNITED STATES PATENT AND TRADEMARK OFFICE

CERTIFICATE OF CORRECTION

PATENT NO. : 5,114,309

DATED : May 19, 1992

INVENTOR(S) : Adrianus J. Hengelmolen

It is certified that error appears in the above-identified patent and that said Letters Patent is hereby corrected as shown below:

Title page, item [30], after "Data" and before "[GB] delete "1990" and insert therefor --1989--

Column 3, claim 2, line 67, cancel "the" (first occurrence) and insert therefor --with--

Signed and Sealed this

Thirty-first Day of August, 1993

Bruce Lehman

*Attest:*

BRUCE LEHMAN

*Attesting Officer*

*Commissioner of Patents and Trademarks*